US006132338A

United States Patent [19]

Shifferaw

[11] Patent Number: 6,132,338

[45] Date of Patent: Oct. 17, 2000

[54] RESILIENT EXERCISE BOARD

[76] Inventor: Tessema D. Shifferaw, 999 W. Cutting Blvd., Point Richmond, Calif. 94801

[21] Appl. No.: 08/428,863

[22] Filed: Apr. 25, 1995

Related U.S. Application Data

[63] Continuation-in-part of application No. 08/088,191, Jul. 6, 1993, abandoned, which is a continuation-in-part of application No. 07/912,552, Jul. 13, 1992, Pat. No. 5,277,675.

[51] Int. Cl.[7] ..... A63B 9/00; A63B 26/00

[52] U.S. Cl. ..... 482/30; 482/52; 482/74

[58] Field of Search ..... 482/23, 26, 27, 482/28, 30, 51, 52, 74, 121, 122, 141, 142; 108/144; 476/135

[56] References Cited

U.S. PATENT DOCUMENTS

| | | | |
|---|---|---|---|
| 2,376,776 | 5/1945 | Jones et al. . | |
| 3,356,367 | 12/1967 | Tewksbury . | |
| 3,371,928 | 3/1968 | Buddo . | |
| 3,616,126 | 10/1971 | Tungseth | 482/23 |
| 3,634,895 | 1/1972 | Childers . | |
| 3,641,601 | 2/1972 | Sieg . | |
| 4,037,834 | 7/1977 | Oaks | 482/51 |
| 4,198,044 | 4/1980 | Holappa . | |
| 4,199,136 | 4/1980 | Mansfield | 482/26 |
| 4,323,231 | 4/1982 | Wilson | 481/51 |
| 4,516,767 | 5/1985 | Eskijian . | |
| 4,629,181 | 12/1986 | Krive . | |
| 4,935,977 | 6/1990 | Yamada | 5/237 |
| 4,984,785 | 1/1991 | Wilkinson . | |
| 5,037,084 | 8/1991 | Flor . | |
| 5,117,596 | 6/1992 | Leslie et al. | 52/126.6 |
| 5,232,419 | 8/1993 | Kozak | 482/80 |
| 5,273,510 | 12/1993 | Puckett et al. | 482/142 |
| 5,277,675 | 1/1994 | Shifferaw . | |
| 5,387,166 | 2/1995 | Gvoich | 482/52 |
| 5,514,017 | 5/1996 | Chimiak | 441/65 |

FOREIGN PATENT DOCUMENTS

| | | | |
|---|---|---|---|
| 2631067 | 1/1977 | Germany | 482/26 |
| 2638968 | 3/1978 | Germany | 482/26 |
| 3416644 | 11/1985 | Germany | 482/23 |
| 8201033 | 10/1982 | Netherlands | 482/23 |
| 700149 | 11/1979 | U.S.S.R. | 482/30 |
| 1710083 | 2/1992 | U.S.S.R. . | |
| 1348531 | 3/1974 | United Kingdom . | |

*Primary Examiner*—Stephen R. Crow
*Attorney, Agent, or Firm*—Flehr Hohbach Test Albritton & Herbert LLP

[57] ABSTRACT

Exercise board comprising a generally rectangular platform having a laminated structure with a horizontally extending substantially rigid substrate and a pad of resilient material on the upper side of the substrate, and bars of resilient spring material extending along opposing side margins of the platform and permitting the platform to flex with a resilient action in response to the weight of a person who is exercising thereon. In some embodiments, the bars are arched and impart an upwardly convex contour to the platform. In others, the bars are eliminated, and the platform is fabricated of a fiber reinforced plastic and formed with an upwardly convex contour or arch.

16 Claims, 6 Drawing Sheets

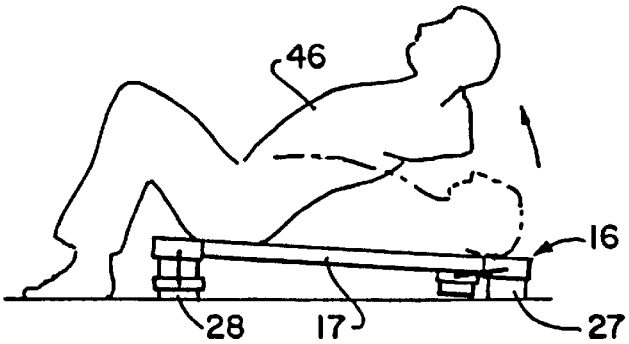
FIG. 6
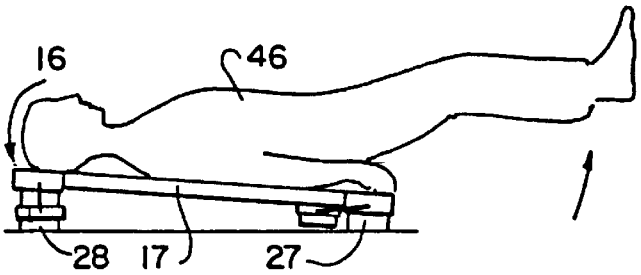
FIG. 7
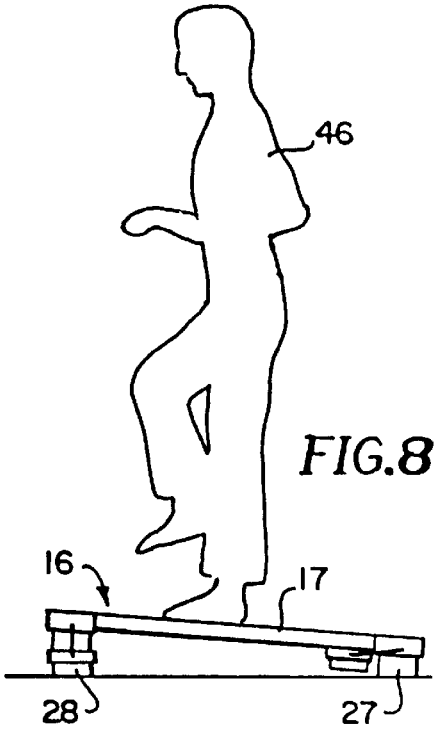
FIG. 8
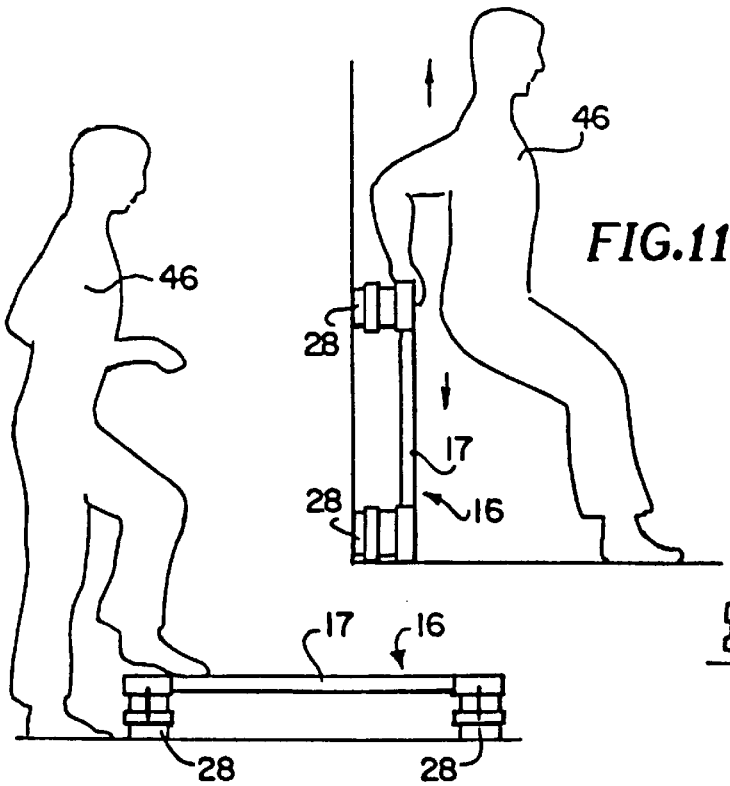
FIG. 11
FIG. 10
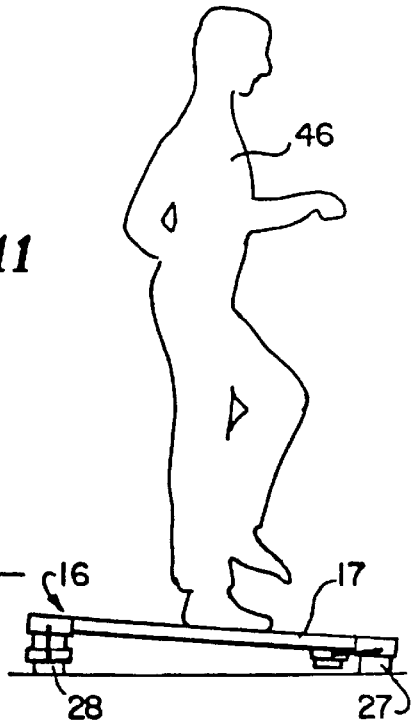
FIG. 9

RESILIENT EXERCISE BOARD

This is a continuation-in-part of U.S. Pat. Ser. No. 08/088,191, filed Jul. 6, 1993, abandoned, which was a continuation-in-part of U.S. Pat. Ser. No. 07/912,552, filed Jul. 13, 1992, now U.S. Pat. No. 5,277,675.

This invention pertains generally to exercise equipment and, more particularly, to a trampoline-type exercise board that can be used for a variety of exercises such as running in place, aerobic exercise and jumping.

Trampolines and like devices generally have a strong flexible mat suspended from a plurality of peripheral springs. Since the mat does not provide a solid surface, feet impacting on the mat during exercise such as jumping and running in place have a tendency to move sideways, which can result in injuries to the ankles and/or legs.

In addition, trampolines and the like tend to reinforce the upward movement of persons bouncing thereon, which can cause a person to jump too high, resulting in over-flexing of the legs and/or injury to the lower back. It can also present problem where overhead clearance is limited, e.g. in a room having a standard ceiling which is only eight feet above the floor.

It is in general an object of the invention to provide a new and improved exercise board.

Another object of the invention is to provide an exercise board of the above character which can be utilized for a variety of exercises such as running in place, aerobic exercise and jumping.

Another object of the invention is to provide an exercise board of the above character which overcomes the limitations and disadvantages of trampolines and like devices heretofore provided.

These and other objects are achieved in accordance with the invention by providing a resilient exercise board comprising a generally rectangular platform having a laminated structure with a horizontally extending substantially rigid substrate and a pad of resilient material on the upper side of the substrate, and bars of resilient spring material extending along opposing side margins of the platform and permitting the platform to flex with a resilient action in response to the weight of a person who is exercising thereon. In some embodiments, the bars are arched and impart an upwardly convex contour to the platform. In others, the bars are eliminated, and the platform is fabricated of a fiber reinforced plastic and formed with an upwardly convex contour or arch.

FIGS. 6–11 are diagrammatic side elevational views illustrating the embodiment of FIG. 1 in use for performing different exercises.

Figure 1:
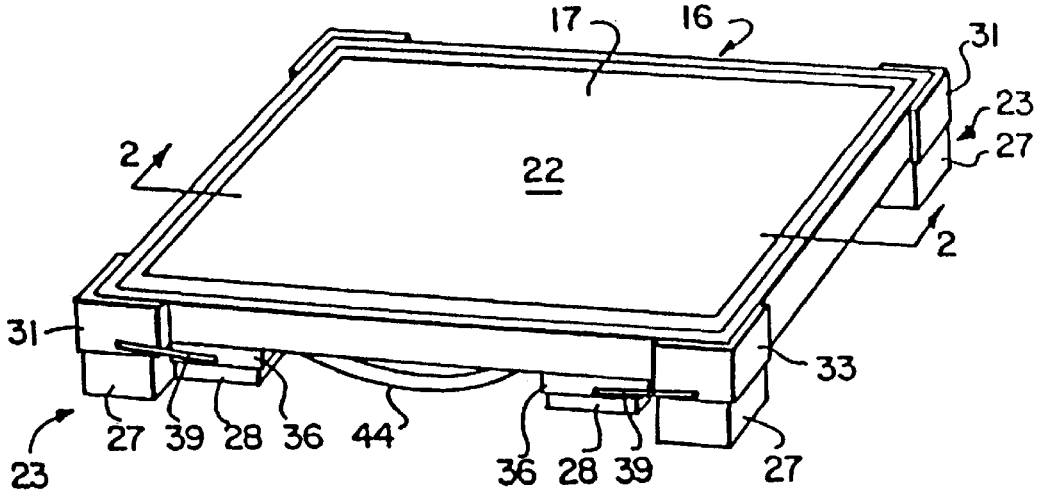
FIG. 1 is an isometric view of one embodiment of a resilient exercise board according to the invention.

As illustrated in the drawings, the exercise board 16 comprises a rectangular, generally planar platform 17 which has a substantially rigid substrate 18 fabricated of a suitable material such as wood, a rigid plastic or a composite wood product. In one presently preferred embodiment, the substrate is fabricated of plywood having a thickness on the order of ½ to ¾ inch.

The platform is of sufficient size to permit a person to perform exercises such as running in place and jumping thereon. In one embodiment, for example, the platform has a surface area on the order of 24 to 36 inches square.

The platform is of laminated construction and has a pad 19 of resilient material on the upper side of the substrate. The pad is fabricated of a rubber-like material such as ethylene vinyl acetate having a thickness on the order of 1 to 1-½ inches and is coextensive in lateral dimension with the substrate.

The platform also includes a flexible cover 21 which overlies the resilient pad and has a skid resistant upper surface 22. The cover can be fabricated of any suitable material such as rubber or a rubberized material.

Resilient feet 23 are provided on the under side of the substrate toward the corners of the platform and are fabricated of a rubber-like material such as neoprene SE 42 which is denser or stiffer than the pad on the upper side of the substrate.

Figure 3:
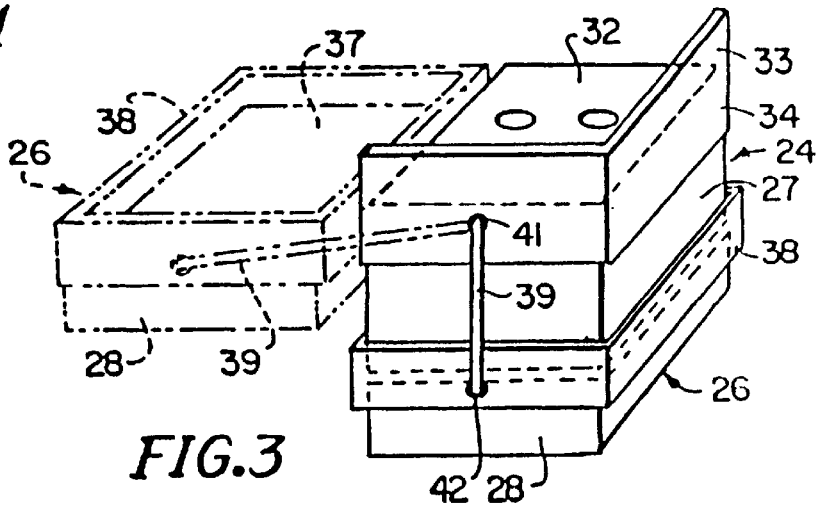
FIG. 3 is an enlarged isometric view of one of the resilient feet in the embodiment of FIG. 1.

The feet are adjustable in height to permit the platform to be positioned in different planes relative to the floor or other supporting surface, e.g. at different heights and at different angles of inclination. In the embodiment illustrated, this adjustment is provided by forming each of the feet in an upper section 24 and a lower section 26. The upper sections are affixed to the under side of the platform by screws, adhesive or other suitable means, and the lower sections are attached to the substrate and upper sections in a manner which permits them to be swung between a retracted position beside the upper sections and an extended position beneath the upper sections. In FIG. 3, the feet are shown in full lines in the extended position and in dashed lines in the retracted position.

The two sections of the resilient feet can be of any suitable dimension. In one present embodiment, each upper section comprises a block 27 of the resilient material having a length on the order of 4 inches, a width on the order of 3 inches and a thickness on the order of 4 inches, and each lower section comprises a block 28 of the same material of similar lateral dimensions and a thickness on the order of 2 inches.

Each upper foot section also includes a cornerpiece 31 which provides lateral support for the block of resilient material in that section. Each cornerpiece has a horizontally extending base plate 32 which is positioned between the upper surface of the block and the lower surface of the substrate, an L-shaped upper side flange 33, and a peripheral lower side flange or skirt 34. The base plate is positioned at the junction of the upper and lower flanges, with the upper flange extending along the side edges of the platform at the corner and the lower flange extending peripherally about the upper portion of the foot block. The cornerpieces are fabricated of a rigid material such as ABS plastic.

Each lower foot section has a retainer 36 comprising a base plate 37 and a peripheral skirt or flange 38. The base plate is positioned at the centerline of the skirt, and the upper side of the lower block 28 is affixed to the underside of the base plate by suitable means such as an adhesive. The upper portion of the skirt and the upper surface of the base plate form a recessed area or socket in which the lower portion of the upper foot block is received when the foot is extended. The retainers are also fabricated of a rigid material such as ABS plastic.

Each lower foot section is mounted to the upper foot section by an elastic cord 39 of the type commonly known as a "bungy" cord or a shock cord. The elastic cord passes through openings 41, 42 in the end portions of flange 34 and skirt 38 and through a slot or groove (not shown) in the upper portion of block 28, with the end portions of the cord being affixed to cornerpiece 31. In the retracted position, the elastic cord holds the lower foot section against the inner side of the upper section, and in the extended position, the cord holds the lower section on the lower side of the upper section.

A handle 44 is attached to the under side of the platform to facilitate carrying of the exercise board. The handle can be of any suitable construction, and in the embodiment illustrated, it comprises a strap of flexible material affixed at its ends to the under side of the substrate.

Figure 2:
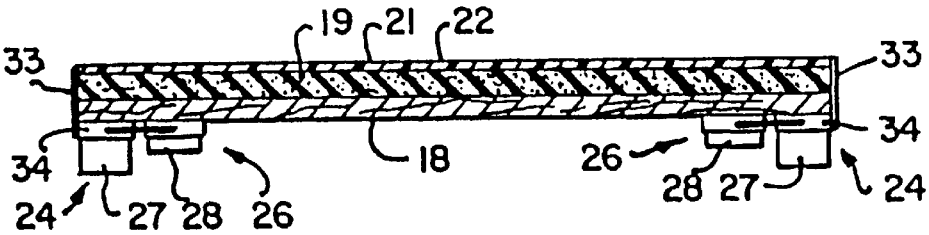
FIG. 2 is a cross-sectional view taken along line 2—2 in FIG. 1.
Figure 4:
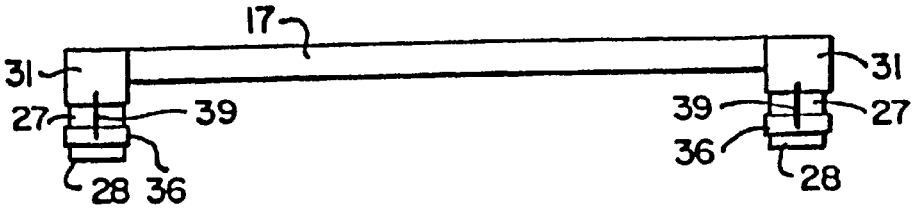
FIGS. 4 and 5 are side elevational views of the embodiment of FIG. 1, showing the resilient feet in different positions.
Figure 5:
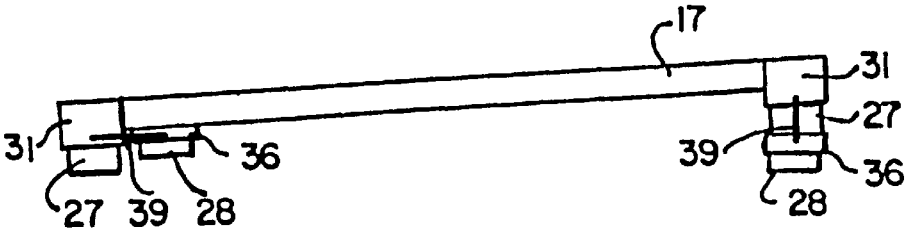

In FIGS. 1 and 2, all four of the resilient feet are illustrated in the retracted position, with the platform spaced about 6 inches above and parallel to the floor or other supporting surface. In FIG. 4, all four feet are all extended, and the platform is once again level, but now at a height of about 8 inches above the floor or supporting surface. In FIG. 5, the feet on the front side of the platform are retracted, the feet at the rear are extended, and the platform is inclined. If desired, the platform can also be inclined be extending the legs at the front or on one side of the platform.

FIGS. 6–11 illustrate some of the exercises which can be done with the exercise board of the invention. FIG. 6 shows a person 46 doing sit-ups on the board, with the platform inclined and the person facing uphill. FIG. 7 shows a person doing leg raises, with the platform inclined and the person facing downhill. FIGS. 8 and 9 show a person jogging or running in place, with the platform inclined and the person running uphill and downhill, respectively. FIG. 10 shows a person doing an aerobic step exercise, with the platform raised and level, and FIG. 11 shows a person doing a triceps pull-up exercise, with the platform in a vertical position with one edge resting on the floor and the feet extended and resting against a wall.

Figure 12:
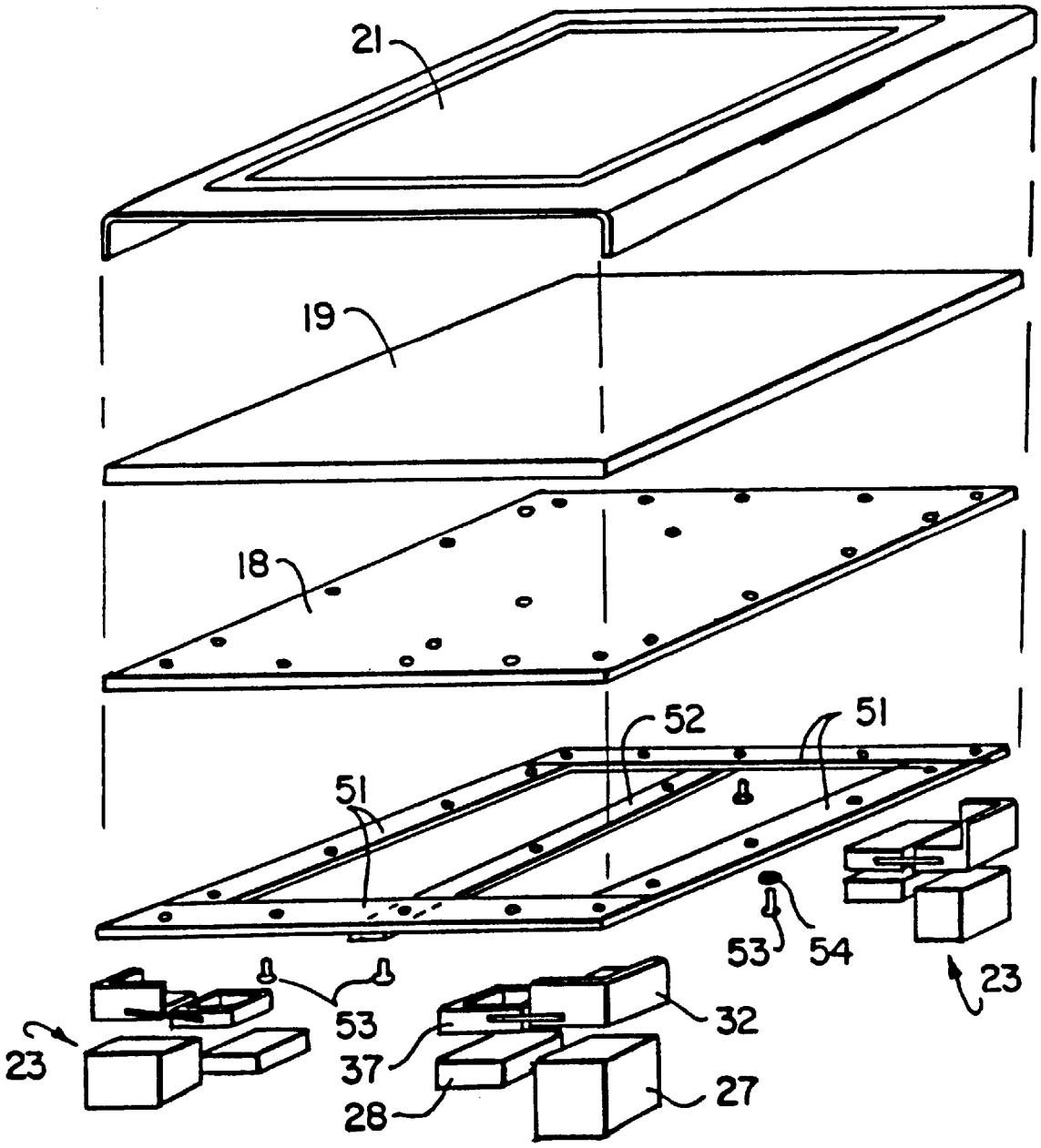
FIG. 12 is an exploded isometric of another embodiment of an exercise board according to the invention.

The embodiment of FIG. 12 is generally similar to that of FIG. 1, and like reference numerals designate corresponding elements in the two embodiments. In the embodiment of FIG. 12, however, the platform is provided with resilient reinforcing elements 51, 52 on the under side of substrate 18. These elements are fabricated of a resilient material such as spring steel bars having a width on the order of about 2 to 2-½ inches and a thickness on the order of ¼ inch. They provide reinforcing for the plywood substrate without detracting from the resilient quality of the platform, making it possible for the plywood substrate to be even thinner than ½ inch. Elements 51 extend along the peripheral margins of the substrate, and element 52 extends centrally between two of the other elements. The resilient elements are secured the under side of the substrate by screws 53 with lock washers 54 to prevent the screws from vibrating loose when the board is in use.

Peripheral reinforcing elements 51 are disposed in a common plane beneath the substrate, with the end portions of those elements bearing upon resilient feet 23. Central element 52 is positioned on the under sides of the two peripheral elements between which it extends and is thus spaced from the under side of the substrate by a distance corresponding to the thickness of the peripheral elements.

Operation and use of the embodiment of FIG. 12 is similar to that hereinbefore described in connection with the embodiment of FIG. 1. However, as noted above, the reinforcing elements make it possible to use a thinner substrate in the embodiment of FIG. 12 than in the embodiment of FIG. 1.

Figure 13:
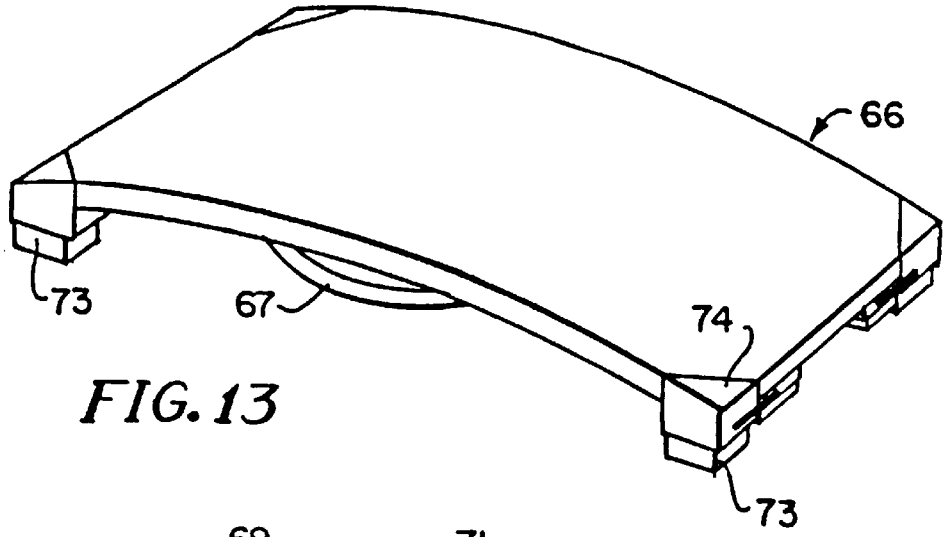
FIG. 13 is an isometric view of another embodiment of an exercise board according to the invention.
Figure 14:
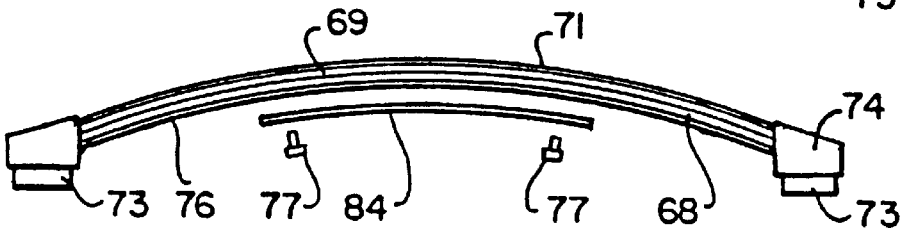
FIG. 14 is a front elevational view, partly exploded, of the embodiment of FIG. 13.
Figure 15A:
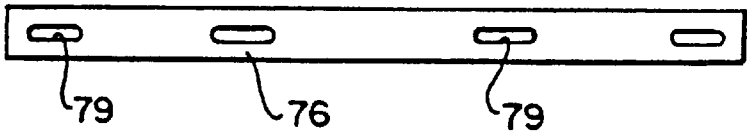
FIGS. 15A and 15B are plan views of spring elements employed in the embodiment of FIG. 13.
Figure 15B:
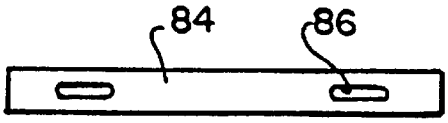
Figure 16:
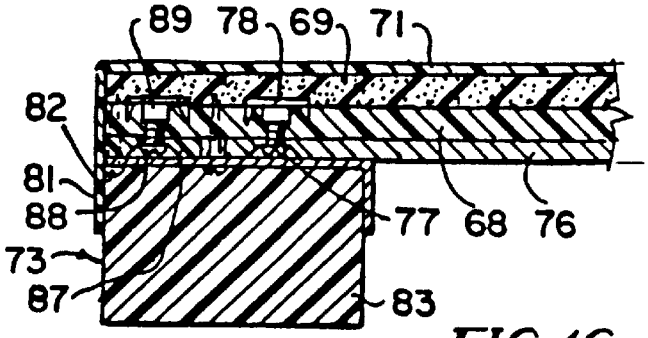
FIG. 16 is a fragmentary sectional view of the embodiment of FIG. 13.

In the embodiment of FIG. 13, the platform 66 has a rectangular shape with a length on the order of 36 inches and a width on the order of 24 inches, with a handle 67 similar to handle 44 attached to the under side of the platform near the midpoint of the front edge.

Like platform 17, platform 66 is of laminated construction, with a substrate 68 of substantially rigid material, a pad 69 of resilient material on the upper surface of the substrate, and a flexible cover 71 with a skid resistant upper surface over the pad. The substrate is fabricated of a material such as wood, a rigid plastic or a wood product, the pad is fabricated of a resilient material such as ethylene vinyl acetate or neoprene foam, and the cover is fabricated of a material such as rubber or a rubberized material. The substrate typically has a thickness on the order of ⅜ to ¾ inch, and the pad has a thickness on the order of ¾ to 1-½ inches. In one presently preferred embodiment, the substrate is fabricated of plywood having a thickness of ⅜ inch, and the pad is fabricated of neoprene foam having a thickness on the order of ¾ inch, which results in a thinner, somewhat more springy platform than one with a thicker, more rigid substrate.

Resilient feet 73, similar to feet 23, are provided toward the four corners of the platform. These feet are oriented such that the lower sections swing toward the shorter sides of the platform in the retracted position. Cornerpieces 74 cover the upper and outer surfaces of the platform at the corners and extend down beside the upper portions of the upper foot sections.

Arched spring elements 76 extend along the front and rear edges of the platform on the under side of substrate 68 and impart an upwardly convex curvature or contour to the platform. In the embodiment illustrated, these elements are in the form of flat bars of rectangular cross-section which can be fabricated of a suitable resilient material such as tempered spring steel, fiberglass or polyurethane or can be formed integrally with, and of the same material as, the substrate. They permit the platform to flex resiliently in response to the weight of a person exercising thereon.

In embodiments in which the springs are not formed integrally with the substrate, they are affixed to it by bolts 77 and T-nuts 78. Two bolts are employed toward the ends of the springs, and two more bolts are spaced at approximately equal distances between the end bolts. The bars which form the springs have longitudinally extending slotted openings 79 for the bolts to permit some degree of movement between the springs and the substrate as they flex. The end portions of the springs are affixed to the feet by means of foot caps 81 which are affixed to substrate 68 by screws 82 and bonded to resilient blocks 83.

If a stiffer spring action is required, springs 76 can be supplemented with additional leaves or springs 84 mounted on the under sides of springs 76. In the embodiment illustrated, the supplemental springs are shorter than the main springs and are affixed to the substrate and the main springs by central bolts 77. Like springs 76, springs 84 are arched and have longitudinally elongated slotted openings 86 to permit movement between the springs and the substrate as the platform flexes. The length and stiffness of the bars which form springs 84 can be selected in accordance with the character of additional stiffness desired.

Reinforcing bars 87 fabricated of a suitable plastic material extend along the short side edges of the platform on the under side of the substrate. These bars are affixed to the substrate by bolts 88 and T-nuts 89 similar to bolts 77 and T-nuts 78.

Operation and use of the embodiment of FIG. 13 are similar to that hereinbefore described in connection with the embodiment of FIG. 1, with the arched springs and thinner platform providing additional resiliency or springiness.

Figure 17:
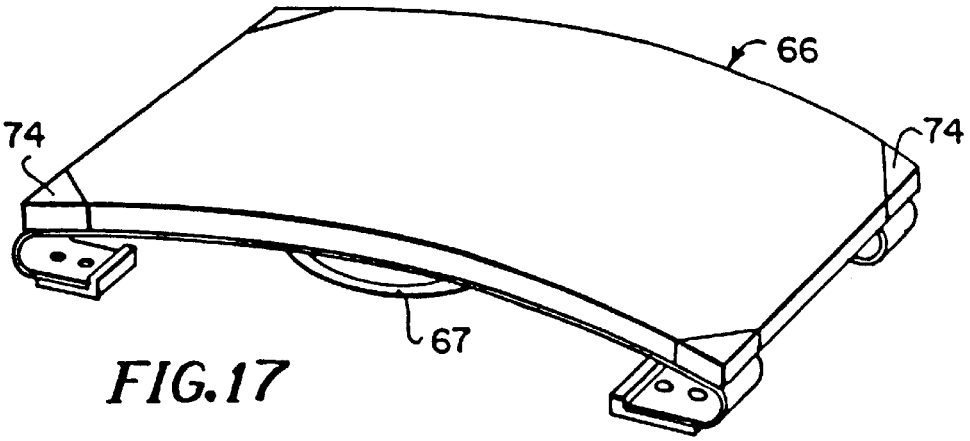
FIG. 17 is an isometric view of another embodiment of an exercise board according to the invention.
Figure 18:
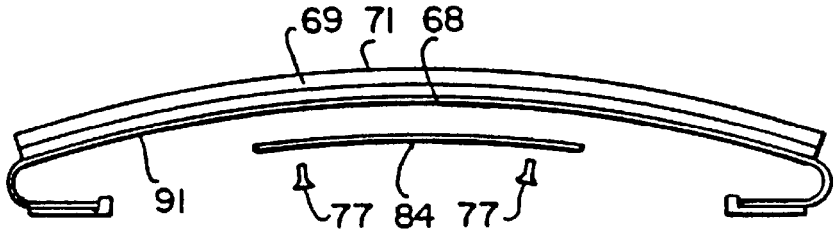
FIG. 18 is a front elevational view, partly exploded, of the embodiment of FIG. 17.
Figure 19A:
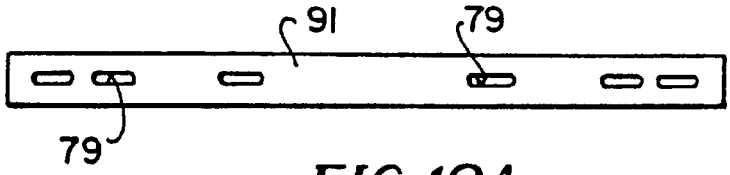
FIGS. 19A and 19B are plan views of spring elements employed in the embodiment of FIG. 17.
Figure 19B:
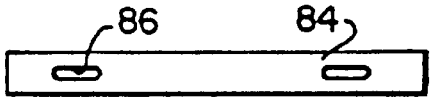
Figure 20:
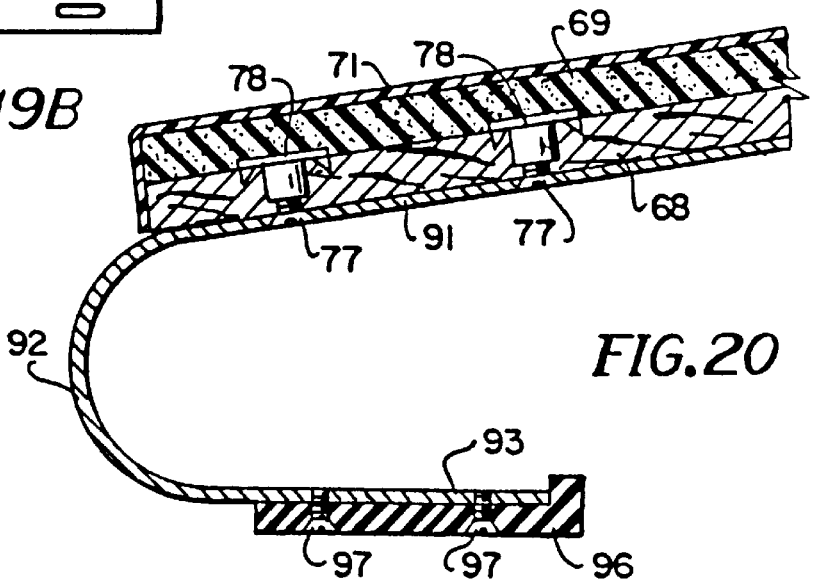
FIG. 20 is a fragmentary sectional view of the embodiment of FIG. 17.

The embodiment of FIG. 17 is generally similar to the embodiment of FIG. 13, and like reference numerals designate corresponding elements in the two embodiments. In the embodiment of FIG. 17, however, the resilient feet which support the platform are formed integrally with and of the same material as the resilient bars.

Arched spring elements 91 extend along the front and rear edges of the platform on the under side of substrate 68 and impart an upwardly convex curvature or contour to the platform. Like elements 76, these elements are illustrated as being in the form of flat bars of rectangular cross-section. They, too, can be fabricated of a suitable resilient material such as tempered spring steel, fiberglass or polyurethane or can be formed integrally with, and of the same material as, the substrate.

The end portions of spring elements 91 are bent down along an outwardly curved path 92 and back under the corner portions of the platform to form resilient supporting feet 93. Pads 96, fabricated of rubber or other suitable material, are affixed to the lower sides of feet 93 by suitable means such as screws 97.

As in the embodiment of FIG. 13, if a stiffer spring action is required, springs 91 can be supplemented with additional leaves or springs 84 mounted on the under sides of springs 91.

Operation and use of the embodiment of FIG. 17 are similar to that hereinbefore described in connection with the embodiment of FIG. 1, with the arched springs and thinner platform providing additional resiliency or springiness.

Figure 21:
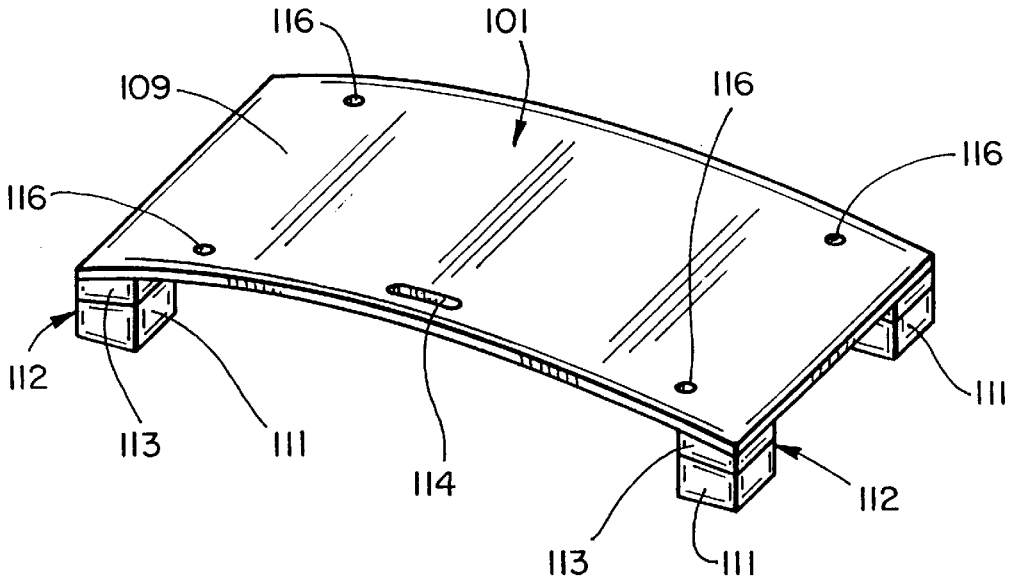
FIG. 21 is an isometric view of another embodiment of an exercise board according to the invention.
Figure 22:
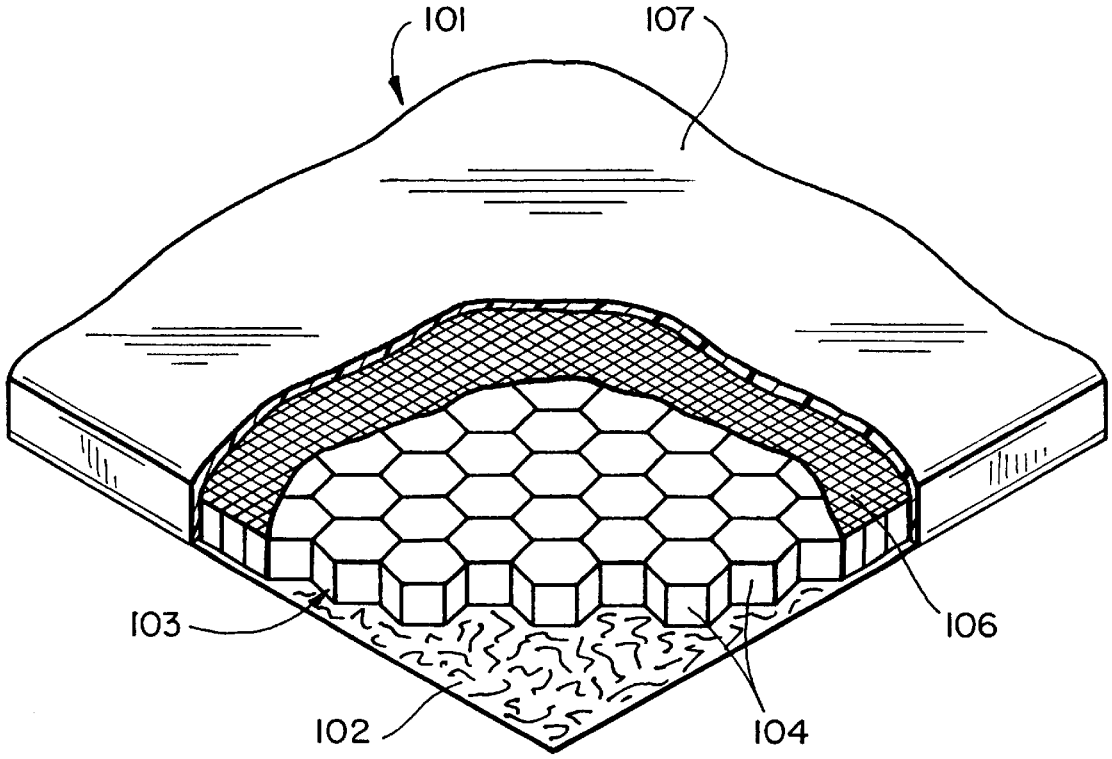
FIG. 22 is an enlarged fragmentary isometric view, partly broken away, of the embodiment of FIG. 21.

In the embodiment of FIG. 21, the board is fabricated of fiber reinforced plastic and is formed with an upwardly convex or arched curvature similar to that provided by the springs in some of the other embodiments. This board has a generally rectangular platform 101 with lateral dimensions similar to those of the other boards.

In the embodiment illustrated, platform 101 is a laminated structure which has a polyester/resin reinforced mat 102 as a base layer. That mat is a thin sheet having relatively short or "chopped" strands of polyester or other suitable fiber in a resinous binder.

A honeycomb core 103 is positioned above the base layer and has a plurality of open cells 104 which extend in a vertical direction between the base layer and the layer above it. The core can be fabricated of any suitable material, and the cells can be of any desired configuration. In one presently preferred embodiment, the core is fabricated of polyurethane, and the cells are hexagonal.

Above the core, there is an additional layer of fibers 106. In one presently preferred embodiment, this layer consists of a cloth-like material commonly known as woven roven. That material has strands of polyester which extend in two mutually perpendicular directions and are woven together. However, any other suitable material can be used, including materials other than polyester and unidirectional materials which have strands extending in one direction only.

A resinous binder 107 covers the top layer of the lamination and fills the interstices between the strands in that layer, fills the cells of the core material and bonds the base layer to the other layers to form a unitary solid structure. In one presently preferred embodiment, the binder is a polyester resin, but any suitable plastic resin can be used.

The platform is constructed on a mold (not shown) and is formed with the desired arch or curvature as it is made. The mat, core and fibrous material are placed on the mold in the desired contour. The resin is then worked into those materials in liquid form and cured in the desired contour.

A resilient pad 109 overlies the upper surface of the reinforced plastic laminate to cushion impact with the platform. In one presently preferred embodiment, the pad is fabricated of neoprene, and the laminate and the pad each have a thickness on the order of ¼ inch.

Resilient feet 111 are affixed to the under side of the platform at the four corners of the board. These feet are fabricated of a material such as neoprene and a adapted to rest on the floor or other supporting surface on which the board is used. The feet are mounted to cornerpieces 112 having depending flanges 113 defining recessed areas in which the upper portions of the feet are received. The feet are affixed to the cornerpieces by an adhesive, and the cornerpieces can either be formed separately and attached to the platform or formed as an integral part of the platform. The board also has a handle 114 for carrying, and openings 116 for the attachment of elastic ("bungy") cords for use in certain types of exercises.

Operation and use of the embodiment of FIG. 21 are similar to that of the other embodiments, with the fiber reinforced plastic structure making the board lighter in weight and easier to carry, as well as being easier and more economical to manufacture than some of the others.

The three layer laminate described thus far is not the only structure the reinforced plastic board can have, but ft is the one which is currently preferred. However, a greater or lesser number of layers can be provided, and different combinations of materials can be used in the different layers. The honeycomb core could, for example, be eliminated, or the board could have just one layer of fiber with a resin binder.

The invention has a number of important features and advantages. It provides a resilient support which reduces impact without throwing a person like a trampoline does. It is readily carried and stored, and can be used for performing a wide variety of exercises. It is inexpensive, does not make any noise and can be used almost anywhere.

It is apparent from the foregoing that a new and improved exercise board have been provided. While only certain presently preferred embodiments have been described in detail, as will be apparent to those familiar with the art, certain changes and modifications can be made without departing from the scope of the invention as defined by the following claims.

What is claimed:

1. A portable, stand alone exercise board, comprising a generally rectangular, substantially rigid platform having an upper surface of sufficient lateral extent to receive a person who is exercising, a plurality of feet positioned toward corners of the platform on the under side of the platform and engagable with a supporting surface, and a pair of arched bars of resilient spring material selected from the group consisting of spring steel, fiberglass and polyurethane extending between the feet along opposing side margins of the platform and imparting an upwardly convex contour to the platform while permitting the platform to flex with a resilient action in response to the weight of a person who is exercising on the board.

2. The exercise board of claim 1 wherein the platform comprises a substantially rigid, generally rectangular substrate, a pad of resilient material overlying the substrate and being substantially coextensive laterally with the substrate, and a cover having a skid resistant upper surface overlying the resilient pad.

3. The exercise board of claim 1 wherein the bars have a generally rectangular cross-section of greater width than thickness, with a major surface of each of the bars positioned flat against the under side of the platform.

4. The exercise board of claim 1 wherein end portions of the bars are bent to form resilient feet for engagement with a supporting surface.

5. The exercise board of claim 4 wherein the end portions of the bars are bent under the corner portions of the platform.

6. A portable, stand alone exercise board, comprising a generally rectangular, substantially rigid platform having an upper surface of sufficient lateral extent to receive a person who is exercising, a plurality of feet positioned toward corners of the platform on the under side of the platform and engagable with a supporting surface, and a pair of arched bars of resilient spring material extending between the feet along opposing side margins of the platform and imparting an upwardly convex contour to the platform while permitting the platform to flex with a resilient action in response to the weight of a person who is exercising on the board, the bars and the platform being formed as a unitary one-piece structure.

7. A portable, stand alone exercise board, comprising a generally rectangular, substantially rigid platform having an upper surface of sufficient lateral extent to receive a person who is exercising, a plurality of feet positioned toward corners of the platform on the under side of the platform and engagable with a supporting surface, and a pair of arched bars of resilient spring material extending between the feet along opposing side margins of the platform and imparting an upwardly convex contour to the platform while permitting the platform to flex with a resilient action in response to the weight of a person who is exercising on the board, the bars and the feet being formed as a unitary one-piece structure.

8. The exercise board of claim 1 wherein the feet are fabricated at least in part of a resilient material.

9. The exercise board of claim 1 wherein the platform comprises a relatively rigid substrate fabricated of a material selected from the group consisting of plywood, plastic, fiberglass, and combinations thereof.

10. The exercise board of claim 9 including a pad on one side of the substrate fabricated of a material selected from the group consisting of ethylene vinyl acetate and neoprene foam, and combinations thereof.

11. The exercise board of claim 10 wherein the substrate has a thickness on the order of ⅜ to ¾ inch, and the pad has a thickness on the order of ¾ to 1-½ inches.

12. The exercise board of claim 1 wherein each of the bars has a width on the order of 2 to 2-½ inches and a thickness on the order of ¼ inch.

13. An exercise board, comprising a platform of fiber reinforced plastic formed with an upwardly convex arch and an upper surface of sufficient lateral extent to receive a person who is exercising, and a plurality of feet on the under side of the platform and engagable with a supporting surface, the fiber reinforced plastic permitting the platform to flex with a resilient action in response to the weight of a person who is exercising on the board, the platform comprising a honeycomb core having vertically extending cells, fibrous strands extending horizontally above and below the core, and a resinous binder material enveloping the strands and filling the cells in the core to form a unitary solid structure.

14. The exercise board of claim 13 wherein the honeycomb core is a polyurethane material, the fiber strands are a polyester material, and the resin is a polyester resin.

15. An exercise board, comprising a platform of fiber reinforced plastic formed with an upwardly convex arch and an upper surface of sufficient lateral extent to receive a person who is exercising, and a plurality of feet on the under side of the platform and engagable with a supporting surface, the fiber reinforced plastic permitting the platform to flex with a resilient action in response to the weight of a person who is exercising on the board, the platform being a laminated structure comprising a base layer of resinous mat reinforced with polyester strands, a honeycomb core overlying the base layer and having vertically extending cells, a layer of bidirectional woven roven overlying the core, and a plastic resin filling the cells and bonding the mat, core and roven together to form a unitary solid structure.

16. An exercise board, comprising a platform of fiber reinforced plastic formed with an upwardly convex arch and an upper surface of sufficient lateral extent to receive a person who is exercising, and a plurality of feet on the under side of the platform and engagable with a supporting surface, the fiber reinforced plastic permitting the platform to flex with a resilient action in response to the weight of a person who is exercising on the board, the platform being generally rectangular and having cornerpieces formed as an integral part thereof with downwardly extending flanges defining recessed areas in which upper portions of the feet are received.

* * * * *